US011735856B2

(12) United States Patent
Ambo

(10) Patent No.: US 11,735,856 B2
(45) Date of Patent: Aug. 22, 2023

(54) ELECTRICAL CONNECTOR AND METHOD FOR LOCKING CONNECTION TERMINAL IN SAID ELECTRICAL CONNECTOR

(71) Applicant: DELTA PLUS CO., LTD., Mie (JP)

(72) Inventor: Tsugio Ambo, Saitama (JP)

(73) Assignee: DELTA PLUS CO., LTD., Mie (JP)

( * ) Notice: Subject to any disclaimer, the term of this patent is extended or adjusted under 35 U.S.C. 154(b) by 130 days.

(21) Appl. No.: 17/611,178

(22) PCT Filed: Jun. 1, 2020

(86) PCT No.: PCT/JP2020/021624
§ 371 (c)(1),
(2) Date: Nov. 15, 2021

(87) PCT Pub. No.: WO2020/246428
PCT Pub. Date: Dec. 10, 2020

(65) Prior Publication Data

US 2022/0216637 A1 Jul. 7, 2022

(30) Foreign Application Priority Data

Jun. 5, 2019 (JP) ..... 2019-105434

(51) Int. Cl.
*H01R 13/436* (2006.01)
*H01R 13/52* (2006.01)
*H01R 43/20* (2006.01)

(52) U.S. Cl.
CPC ..... *H01R 13/4364* (2013.01); *H01R 13/5202* (2013.01); *H01R 43/20* (2013.01)

(58) Field of Classification Search
CPC ..... H01R 13/4364; H01R 13/4365; H01R 13/4367; H01R 13/506; H01R 13/5202; H01R 13/5219; H01R 43/20
See application file for complete search history.

(56) References Cited

U.S. PATENT DOCUMENTS 5,779,501 A * 7/1998 Hotra ..... H01R 13/4364 439/744
6,179,671 B1 * 1/2001 Ohsumi ..... H01R 13/4364 439/752

(Continued)

FOREIGN PATENT DOCUMENTS

JP 2174081 A 7/1990
JP 2011187204 A 9/2011

(Continued)

*Primary Examiner* — Oscar C Jimenez
(74) *Attorney, Agent, or Firm* — Li & Cai Intellectual Property Office

(57) ABSTRACT

A locking plate portion is disposed so as to be movable in a lateral direction. A connection terminal is inserted while a locking piece of a connection portion of the connection terminal passes through an insertion groove of the locking plate portion Subsequently, an operating member is pushed in an arrow direction with respect to the locking plate portion and the locking plate portion is laterally moved by a wedge mechanism. Then, the locking piece is transferred to a locking portion provided in the front end side portion of the insertion groove. As a result, the locking portion locks the rear portion of the locking piece and a rearward movement of the connection terminal is regulated.

11 Claims, 10 Drawing Sheets

(56) References Cited

U.S. PATENT DOCUMENTS

| | | | | |
|---|---|---|---|---|
| 7,785,145 | B2 * | 8/2010 | Menez | H01R 13/6315 439/271 |
| 10,164,371 | B2 * | 12/2018 | Hara | H01R 13/4362 |
| 11,043,773 | B2 * | 6/2021 | Ambo | H01R 13/506 |
| 2014/0120762 | A1 * | 5/2014 | Kuroda | H01R 13/4362 439/370 |

FOREIGN PATENT DOCUMENTS

| | | | |
|---|---|---|---|
| JP | 2018120666 | A | 8/2018 |
| JP | 201996548 | A | 6/2019 |
| WO | WO2017199847 | A1 | 11/2017 |

* cited by examiner

ELECTRICAL CONNECTOR AND METHOD FOR LOCKING CONNECTION TERMINAL IN SAID ELECTRICAL CONNECTOR

FIELD OF THE DISCLOSURE

The present invention relates to an electrical connector that is used for automotive electric circuit connection or the like and can be reliably held in a housing even with a small connection terminal and a method for locking a connection terminal in the electrical connector.

BACKGROUND OF THE DISCLOSURE

In the related art, a connection terminal incorporated in the housing of an electrical connector is prone to so-called back slip (pulling out to the rear from the housing) when a strong force is applied to the electric wire pulled out to the outside during harness processing or attachment to a car body. The back slip of the connection terminal impairs the function as an electrical connector, and thus the back slip is prevented by a locking mechanism provided in the housing and, in general, a flexible case lance provided in the housing performs locking.

In recent years, however, a case lance alone is unlikely to be enough for a sufficient locking force as housings and case lances are required to be reduced in size along with connection terminals.

Known in this regard is an electrical connector in which a case lance locks a connection terminal in a housing, a wide side holder is inserted from the side of the housing, and the connection terminal is locked in the housing as in Patent Document 1.

In this electrical connector, the main body portion of the side holder is inserted in the housing from the side portion of the housing. In a case where the connection terminal is locked in the housing, the locking piece attached to the connection terminal is locked by the inserted side holder.

CITATION LIST

Patent Document

Patent Document 1: JP-A-2011-86504

SUMMARY OF THE DISCLOSURE

Technical Problem

However, in the electrical connector of Patent Document 1, a large hole portion for side holder insertion has to be formed in the side portion of the housing, it is difficult to waterproof the hole portion, and water infiltration into the housing is likely to occur. Accordingly, the electrical connector of Patent Document 1 is not suitable as an electrical connector requiring waterproofness during inter-connection terminal connection.

In addition, the side holder has an end portion exposed on the outer surface of the side portion of the housing at all times, and thus the side holder may escape from the housing due to an unexpected contact with another member.

Solution to Problem

An object of the invention for solving the above problems is to provide an electrical connector and a method for locking a connection terminal in the electrical connector in which the incorporated connection terminal is reliably locked and prevented from escaping to the rear by a locking plate portion incorporated in a housing being moved in the housing by an operating member inserted from the front of the housing.

Advantageous Effects of the Invention

According to the electrical connector and the method for locking the connection terminal in the electrical connector of the invention, the connection terminal is locked by the movable locking plate portion provided in the housing main body being moved by the operating member of another member inserted from the front, and thus the connection terminal can be reliably held in the housing.

In addition, it is possible to maintain waterproofness in the state of fitting with the electrical connector on the other side by forming the push-in port for pushing in the operating member in the front surface of the housing main body.

DETAILED DESCRIPTION OF THE EXEMPLARY EMBODIMENTS

The invention will be described in detail with reference to the illustrated example.

Figure 1:
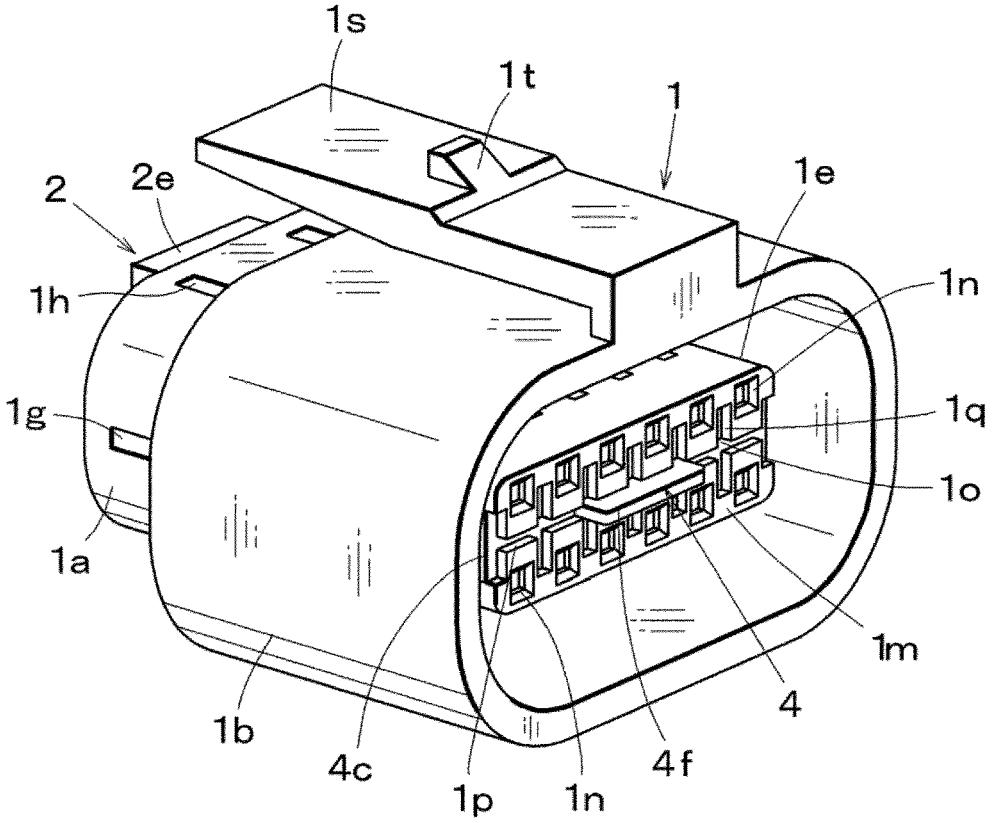
FIG. 1 is a perspective view in which an assembled electrical connector is seen from the front.
Figure 2:
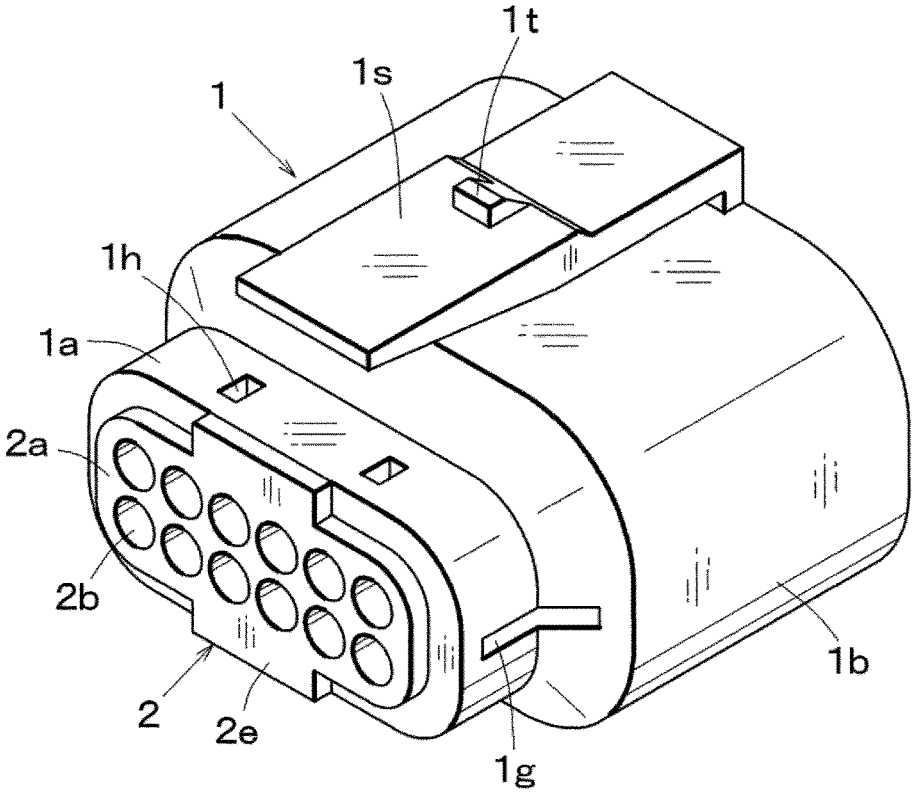
FIG. 2 is a perspective view in which the assembled electrical connector is seen from the rear.
Figure 3:
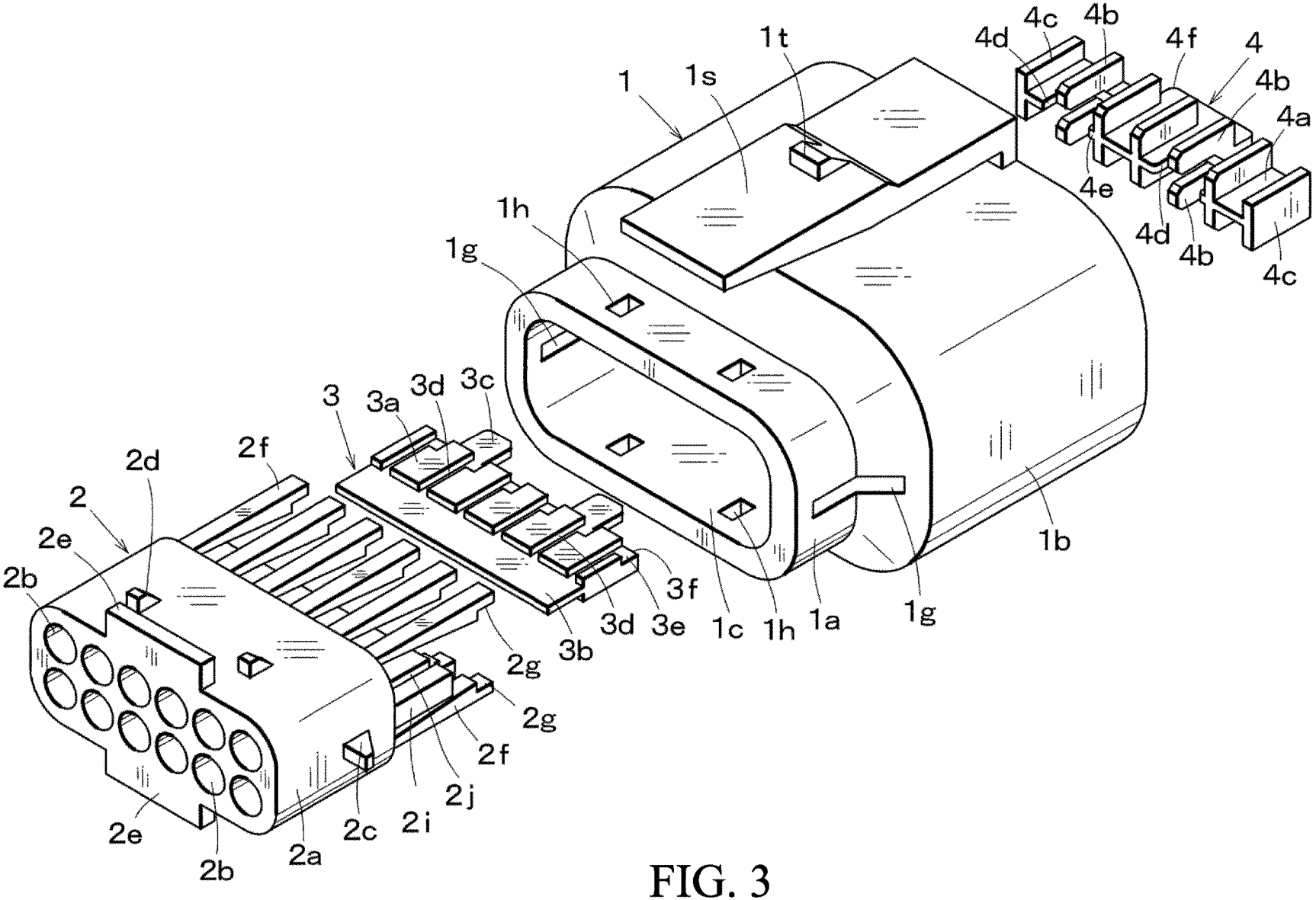
FIG. 3 is a perspective view in which a disassembled electrical connector is seen from the rear.
Figure 4:
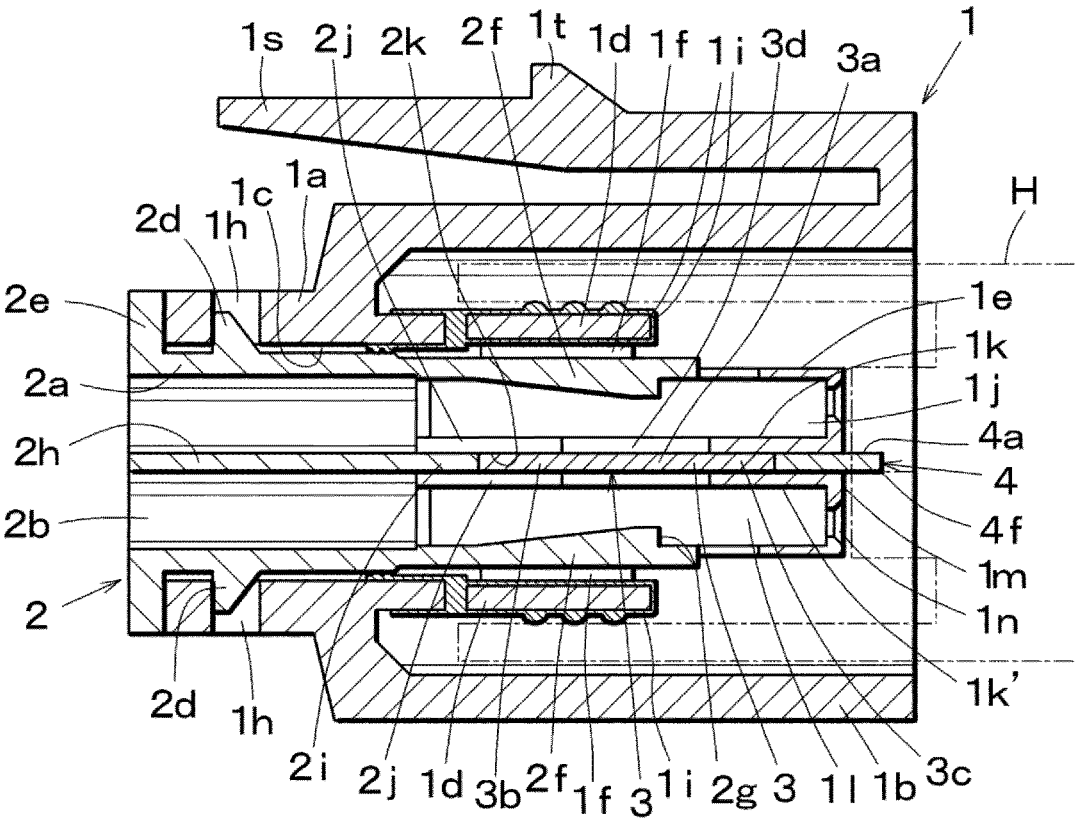
FIG. 4 is a vertical cross-sectional view in which the assembled electrical connector is vertically cut.
Figure 5:
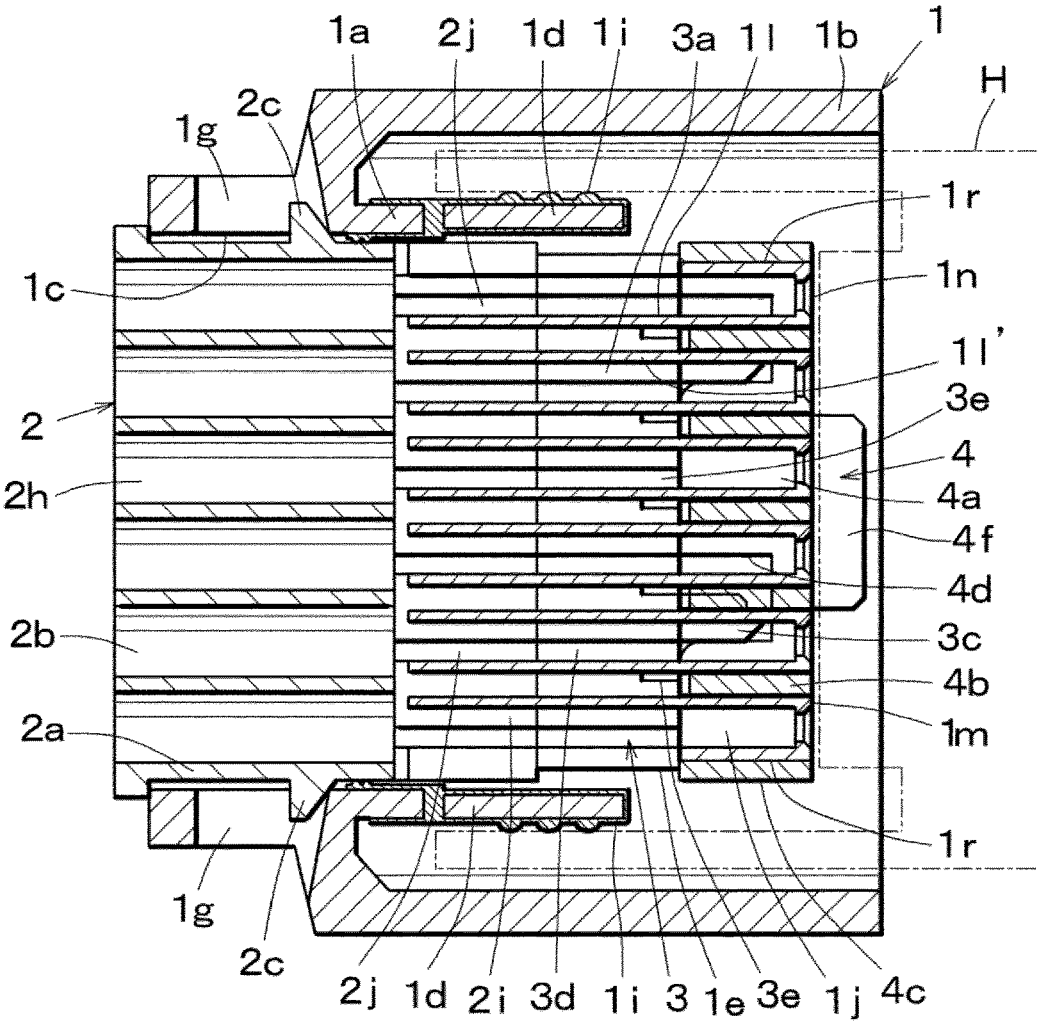
FIG. 5 is a vertical cross-sectional view in which the assembled electrical connector is horizontally cut.

FIG. 1 is a perspective view in which the electrical connector of the example that is assembled is seen from the front. FIG. 2 is a perspective view in which the assembled electrical connector is seen from the rear. FIG. 3 is a perspective view of a disassembled state seen from the rear. FIG. 4 is a vertical cross-sectional view in which the assembled electrical connector is vertically cut. FIG. 5 is a vertical cross-sectional view in which the assembled electrical connector is horizontally cut.

The electrical connector includes a housing main body 1, a terminal holder 2 inserted into the housing main body 1 from the rear of the housing main body 1, a locking plate portion 3 connected to the front end of the terminal holder 2 and movable in the lateral direction that is orthogonal to the direction in which the terminal holder 2 is inserted, and an operating member 4 inserted from the front of the housing main body 1 and internally moving the locking plate portion 3 in the lateral direction. It should be noted that each of the housing main body 1, the terminal holder 2, the locking plate portion 3, and the operating member 4 is made of a synthetic resin material and manufactured by injection molding.

The terminal holder 2 incorporating a connection terminal (described later) is inserted inward from the rear portion of the housing main body 1. In addition, the locking plate portion 3 is connected to the tip of the terminal holder 2 so as to be movable in the lateral direction, the locking plate portion 3 is inserted into the housing main body 1 together with the terminal holder 2, and the locking plate portion 3 is operated by the operating member 4 pushed in from the front portion of the housing main body 1. As a result of this operation, the locking plate portion 3 moves in the lateral direction that is orthogonal to the direction in which the locking plate portion 3 is inserted with respect to the terminal holder 2 and locks the rear end of the locking piece of the incorporated connection terminal.

In the example of the electrical connector, for example, a total of 12 receiving-type connection terminals (so-called female terminals, six rows in the upper stage and six rows in the lower stage) can be incorporated from the rear side and inter-connection terminal electrical connection is performed by connection on the front side to a counterpart electrical connector incorporating the same number of insertion-type connection terminals (so-called male terminals).

The size of this small electrical connector that is assembled is, for example, 24 mm in width, 14 mm in height, and 24 mm in length. An appropriate size can be adopted in accordance with, for example, the size and number of the connection terminals.

Figure 6:
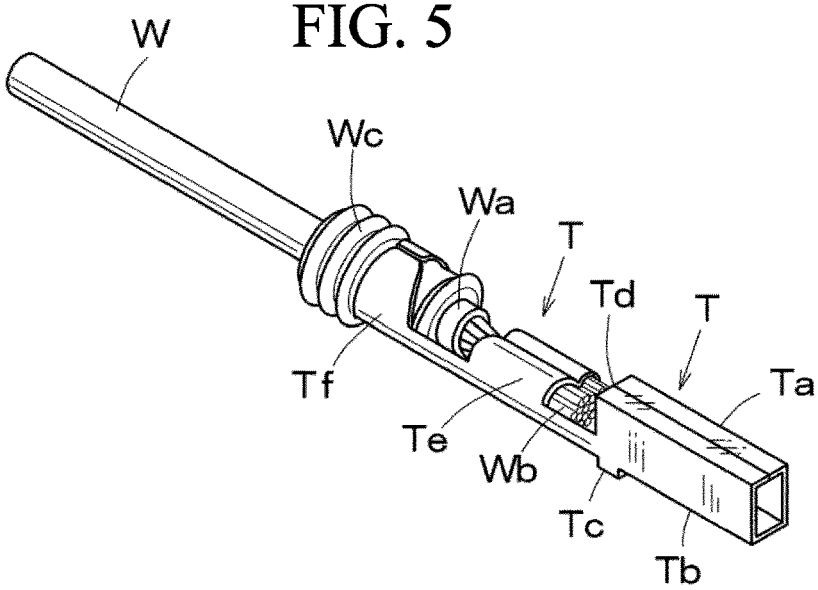
FIG. 6 is a perspective view of a connection terminal.

The connection terminal incorporated in the housing main body 1 will be described first. As illustrated in the perspective view of FIG. 6, the connection terminal is, for example, a receiving-type connection terminal with a total length of 15 mm formed by punching and bending a conductive metal plate (such as a brass plate) with a thickness of, for example, 0.15 mm. A square tube-shaped receiving connection portion Ta approximately 4.8 mm in length, 1.1 mm in width, and 1.6 mm in height is formed in the front portion of a connection terminal T. It should be noted that the dimensions do not limit the size of the connection terminal T.

On one width-direction side of the rear end of a bottom surface Tb of the connection portion Ta, a locking piece Tc formed by a notch in the bottom surface Tb and locked by the locking plate portion 3 protrudes downward and along the front-rear direction. The locking piece Tc is formed to have a height of, for example, 0.4 mm with the side end portion cut out in a fin shape directed downward once and then folded back upward in a U shape.

The locking piece Tc serves as a guide when the connection terminal T is inserted, serves as a stabilizer for stabilizing the posture of the connection terminal after the insertion, and has a function of preventing the connection terminal T itself from escaping to the rear. Further, the upper end of the rear portion of the connection portion Ta is a pressed portion Td against which the case lance formed on the terminal holder 2 abuts from the rear.

An electric wire W with an outer diameter of approximately 1 mm covered with a covering portion Wa is connected to the rear end portion of the connection terminal A core wire portion Wb at the tip of the electric wire W exposed from the covering portion Wa, is crimp-connected to the connection terminal T by bending a U-shaped core wire crimping portion Te. Further, behind the core wire crimping portion Te, a cylindrical sealing material Wc made of a synthetic rubber for waterproofing and inserted outside the covering portion Wa is crimp-fixed together with the covering portion Wa by bending a U-shaped covering crimping portion Tf.

A middle tube 1*a* is provided in the middle portion of the housing main body 1. An outer tube 1*b* is disposed, with a gap, on the outside of the housing main body 1 so as to largely surround the middle tube 1*a*. The rear portion of the outer tube 1*b* is connected behind the middle tube 1*a*, and the middle tube 1*a* and the outer tube are integrally molded.

In the rear portion of the middle tube 1*a*, a holder holding portion 1*c* is open rearward so that the terminal holder 2 can be inserted. The rear frame portion of the inserted terminal holder 2 is held by the holder holding portion 1*c*, and the front end of the middle tube 1*a* inside the outer tube 1*b* is a waterproof portion 1*d* slightly reduced in outer diameter.

A tubular terminal holding portion 1*e* smaller in diameter than the middle tube 1*a* is formed further forward inside the middle tube 1*a* and with a slight gap from the middle tube 1*a*. The terminal holding portion 1*e* is supported by a plurality of ribs 1*f* from the inside of the middle tube 1*a*. It should be noted that a gap is provided between the ribs 1*f* so that the case lance of the terminal holder 2 (described later) can enter. The terminal holding portion 1*e* is for holding the connection portion Ta of the connection terminal T therein, and the front wall of the terminal holding portion 1*e* is almost blocked with an opening portion (described later) and the operating member 4 left.

Long groove-shaped coupling groove portions 1*g* for temporary insertion are formed as mechanisms for coupling the housing main body 1 and the terminal holder 2 to each other. The coupling groove portions 1*g* are formed in both side portions of the holder holding portion 1*c*. When the terminal holder 2 is temporarily inserted, a coupling protrusion 2*c* for temporary insertion of the terminal holder 2 is fitted into the coupling groove portion 1*g*. In addition, two coupling groove portions 1*h* for main insertion in the upper portion of the holder holding portion 1*c* and two coupling groove portions 1*h* for main insertion in the lower portion of the holder holding portion 1*c* are formed as similar coupling mechanisms to receive coupling protrusions 2*d* for main insertion, which are provided on the terminal holder 2, during the main insertion of the terminal holder 2.

During the use of the electrical connector, a housing H on the other side is inserted between the middle tube 1*a* and the outer tube 1*b*. For this reason, the periphery of the tip of the middle tube 1*a* is surrounded by a synthetic rubber made of, for example, silicon rubber as a waterproof member with respect to the housing H. This seal portion 1*i* is connected on both the inner and outer surfaces of the middle tube 1*a* via the small hole provided in the waterproof portion 1*d* and, on both the inner and outer surfaces, each cross section is wavy so that water infiltration is effectively blocked. It is preferable that the seal portion 1*i* is attached during the injection molding of the housing main body 1 and further cross-linked.

A total of 12 connection portion accommodating chambers 1*j* (six rows on the left and six rows on the right in the upper and lower stages) with a square cross section are provided in the terminal holding portion 1*e* and individually store the connection portions Ta of the connection terminals T. Bottom plates 1*k* and 1*k'* for respectively supporting the bottom surfaces Tb of the connection terminals T are disposed back to back with a gap between the upper and lower connection portion accommodating chambers 1*j*. The total thickness of the bottom plates 1*k* and 1*k'* including the gap is, for example, 1.4 mm.

On both the upper and lower surfaces of the bottom plates 1*k* and 1*k'*, a total of 10 sets of partition walls 1*l* and 1*l'* (one upper wall and one lower wall constituting one set) extend with sufficient length in the longitudinal direction so that the connection terminals T adjacent to the right and left are partitioned. A gap is provided between the partition walls 1*l* and 1*l'*. Further, the space surrounded by the bottom plates 1*k* and 1*k'* and the partition walls 1*l* and 1*l'* is the connection portion accommodating chamber 1*j* where the connection portion Ta is individually stored. It should be noted that the horizontal plate of the operating member 4 (described later) is inserted into the gap between the bottom plates 1*k* and 1*k'* and the vertical plate of the operating member 4 is inserted into the gap between the partition walls 1*l* and 1*l'*.

Although the front surface of the terminal holding portion 1*e* is blocked by a front wall 1*m*, a total of 12 quadrangular opening portions in (six above and six below), into which the insertion ends of the insertion-type connection terminals on the other side are respectively inserted, are formed in the front wall 1*m* so as to correspond to the inserted individual connection terminals T. Further, the front wall 1*m* is provided with a push-in port 1*o* for the operating member 4 inserted into the housing main body 1 so that the locking plate portion 3 is moved in the lateral direction. It should be noted that one horizontal groove 1*p* and a plurality of vertical grooves 1*q* are formed as the push-in port 1*o*, the horizontal groove 1*p* is provided between the upper and lower opening portions 1*n*, the vertical groove 1*q* is provided between the right and left opening portions 1*n*, the horizontal groove 1*p* communicates with the gap between the bottom plates 1*k* and 1*k'* of the terminal holding portion 1*e*, and the vertical groove 1*g* communicates with the gap of the partition walls 1*l* and 1*l'*.

Recess portions 1*r* into which the side plates on both sides of the operating member 4 are fitted are provided on both the right and left outer sides of the terminal holding portion 1*e*. Further, an elastic locking arm 1*s* for locking and maintaining the state of connection to the counterpart connector is formed in the upper middle portion of the outer tube 1*b* of the housing main body 1 and a locking claw 1*t* protrudes thereon.

A frame portion 2*a* inserted into the holder holding portion 1*c* of the middle tube 1*a* is provided in the rear portion of the terminal holder 2. The frame portion 2*a* is provided with a total of 12 open holes 2*b* (six rows on the left and six rows on the right in the upper and lower stages) into which the connection terminals T are individually inserted. The open holes 2*b* have a circular cross section and a diameter of, for example, approximately 2.3 mm.

The coupling protrusions 2*c* for temporary insertion fitted in the coupling groove portions 1*g* for temporary insertion of the holder holding portion 1*c* with the terminal holder 2 temporarily inserted protrude outward one by one on both the right and left side portions of the frame portion 2*a*. In addition, each of the upper and lower portions of the frame portion 2*a* is provided with two coupling protrusions 2*d* for main insertion and the four upward and downward coupling protrusions 2*d* are fitted in the coupling groove portions 1*h* for main insertion of the holder holding portion 1*c* in the main insertion state. Further, a stopper 2*e* for stopping the insertion of the terminal holder 2 with respect to the middle tube 1*a* during the main insertion at a predetermined position is provided upward and downward in the rear end portion of the terminal holder 2.

It should be noted that the coupling protrusions 2*c* and 2*d* may be provided on the holder holding portion 1*c* and the coupling groove portions 1*g* and 1*h* may be provided in the frame portion 2*a*.

From the upper and lower portions of the front portions of the open holes 2*b* of the frame portion 2*a*, a total of 12 elastic case lances 2*f* (six each) protrude forward for each incorporated connection terminal T. As for the connection terminals T, the six connection portions Ta in the connection portion accommodating chambers 1*j* of the upper stage of the terminal holding portion 1*e* and the six connection portions Ta in the connection portion accommodating chambers 1*j* of the lower stage of the terminal holding portion 1*e* are incorporated in vertical symmetry, and thus the upper and lower case lances 2*f* are provided in vertical symmetry so as to correspond thereto. In addition, a hook portion 2*g* for abutting against and pressing the pressed portion Td of the connection portion Ta of the connection terminal T from the rear is formed in the vicinity of the tip of each case lance 2*f* and the upper and lower hook portions 2*g* are provided in vertical symmetry.

A partition portion 2*h* partitioning the open holes 2*b* upward and downward and having a semicircular arc-shaped inner cross section continuous with the open hole 2*b* is provided between the upper and lower open holes 2*b* of the frame portion 2*a*. The thinnest part of the partition portion 2*h* has a thickness of 0.45 mm. Further, a flat plate-shaped terminal placement plate 2*i* extends in front of the partition portion 2*h*. The terminal placement plate 2*i* has a thickness of, for example, 1.4 mm and allows the bottom surface Tb of each connection terminal T to be placed on both the upper and lower surfaces.

Six insertion grooves 2*j* are formed in the front-rear direction in each of the upper and lower surfaces of the terminal placement plate 2*i* so that the locking piece Tc passes forward during the insertion of the connection terminal T. The insertion groove 2*j* has, for example, a width of 0.6 mm and a depth of 0.4 mm. It should be noted that the locking piece Tc is formed close to one width-direction side of the connection portion Ta and thus the upper and lower insertion grooves 2*j* are formed so as to be mutually misaligned in bilateral symmetry.

The lopsided formation of the insertion grooves 2*j* is the same as in the case of the insertion grooves in both the upper and lower surfaces of the locking plate portion 3 illustrated in FIG. 8 (described later). In addition, a wide slit-shaped connecting hole 2*k* is formed at the front end of the terminal placement plate 2*i* so that the insertion plate of the locking plate portion 3 (described later) is received so as to be movable in the lateral direction.

Figure 7:
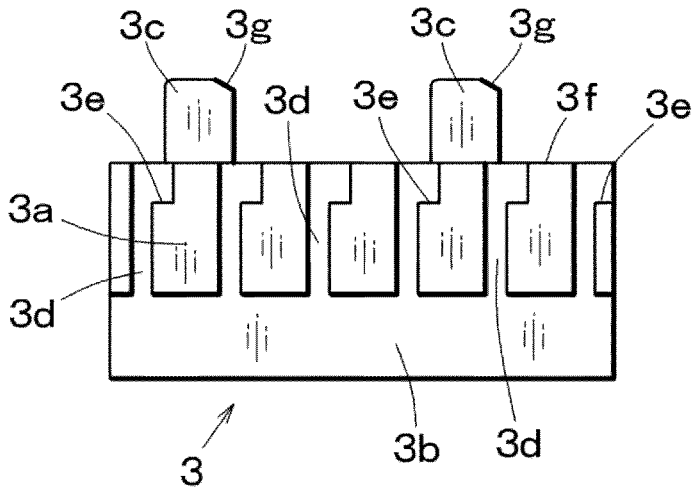
FIG. 7 is a plan view of a locking plate portion.
Figure 8:
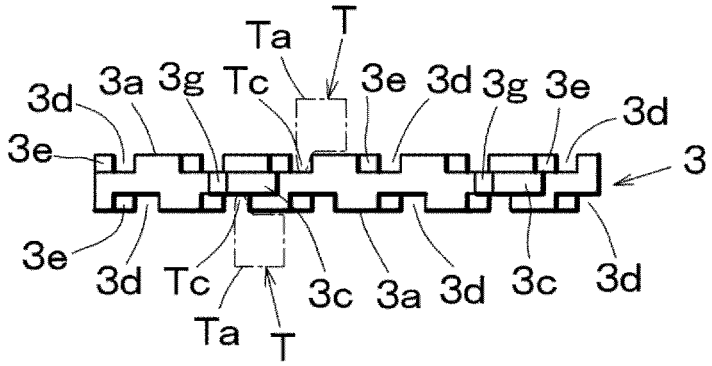
FIG. 8 is a front view of the locking plate portion.

As illustrated in the plan view of FIG. 7 and the front view of FIG. 8, the locking plate portion 3 includes a substrate portion 3*a*, an insertion plate 3*b* protruding rearward, and two operated ends 3*c* protruding forward. The substrate portion 3*a* is a substantially rectangular plate body with a thickness of 1.4 mm, which is the same as the gap of the bottom plates 1*k* and 1*k'* of the terminal holding portion 1*e* and the gap of the terminal placement plate 2*i* of the terminal holder 2.

A total of six insertion grooves 3*d* are formed in the front-rear direction in each of the upper and lower surfaces of the substrate portion 3*a*. The 12 insertion grooves 3*d* communicate with the insertion grooves 2*j* in the terminal placement plate 2*i* at the position of insertion and connection of the locking plate portion 3 into and to the terminal holder 2 and have a width of 0.6 mm and a depth of 0.4 mm as in the case of the insertion groove 2*j*. In addition, a stepped notch provided in the width direction is formed in the front end side portion of each insertion groove 3*d*. The notch is a locking portion 3*e* for locking the locking piece Tc such that the connection terminal does not escape to the rear.

It should be noted that the one-dot chain line in FIG. 8 indicates a state where the locking piece Tc of the connection terminal is inserted through the insertion groove 3*d* of the locking plate portion 3.

Although the insertion plate 3*b* is fitted into the connecting hole 2*k* of the terminal holder 2, the insertion plate 3*b* is narrower than the connecting hole 2*k* and has a plate body shape having a thickness of approximately 0.6 mm. In addition, the operated end 3*c* is a strip having a thickness of approximately 0.6 mm and protruding forward from a front edge 3*f* of the substrate portion 3*a*. A receiving slope portion 3*g* is formed on one side of the tip of the operated end 3*c*. The receiving slope portion 3*g* is a wedge mechanism for redirection for laterally moving the locking plate portion 3 with respect to the housing main body 1 and the terminal holder 2 by means of the operating member 4.

Figure 9:
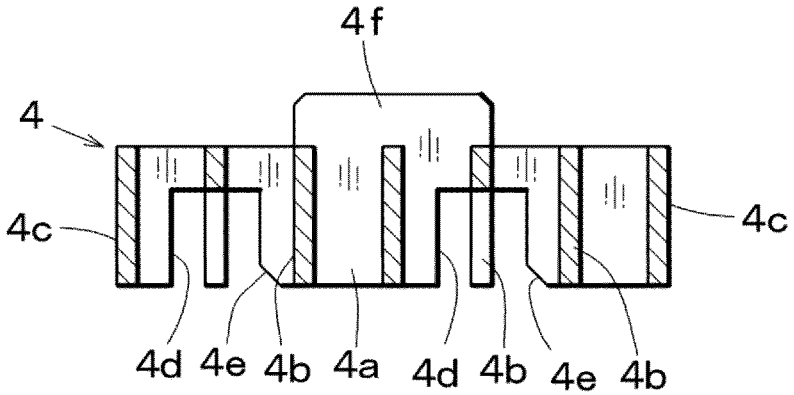
FIG. 9 is a plan view of an operating member.

The operating member 4 is a member for laterally moving the internal locking plate portion 3 by pushing into the terminal holding portion 1*e* from the push-in port 1*o* of the front wall 1*m* of the housing main body 1. As illustrated in the plan view of FIG. 9, the operating member 4 includes a horizontal plate 4*a* with a thickness of 0.6 mm entering the gap of the bottom plates 1*k* and 1*k*', a plurality of vertical plates 4*b* with a thickness of 0.6 mm entering the gap of the partition walls 1*l* and 1*l*', and a pair of side plates 4*c* on both sides.

Two recess portions 4*d* receiving the operated end 3*c* of the locking plate portion 3 are formed in the insertion direction of the horizontal plate 4*a*, that is, at the front end. At two locations on one side of the entrance of the recess portion 4*d*, a push slope portion 4*e* as an operating portion is provided in order to laterally move the locking plate portion 3 in cooperation with the receiving slope portion 3*g* of the operated end 3*c*. In addition, a push-in piece 4*f* is provided at the rear end of the horizontal plate 4*a* so that the operating member 4 is pushed in and the operating member 4 is pulled out as needed.

Figure 10:
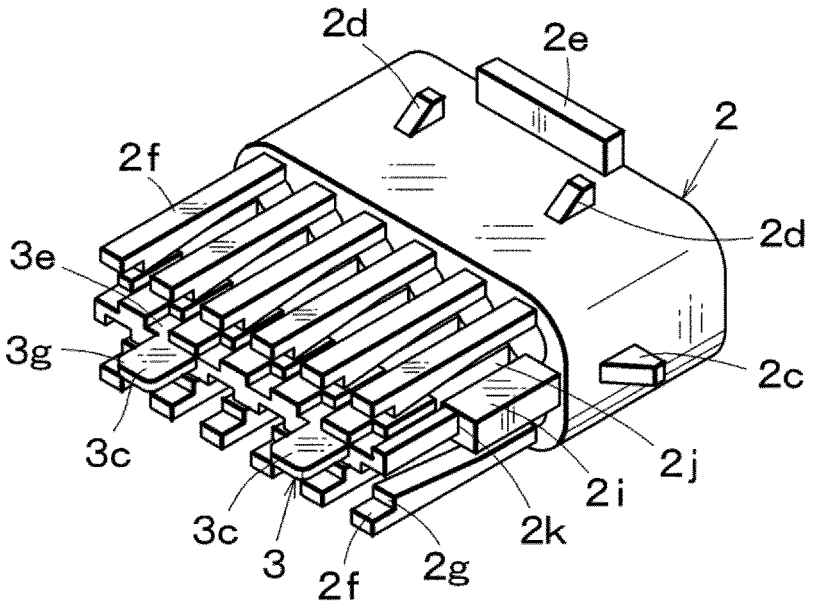
FIG. 10 is a perspective view of a state where the locking plate portion is connected to a terminal holder.

As illustrated in FIG. 10, during the assembly of the electrical connector, the insertion plate 3*b* of the locking plate portion 3 is inserted into the connecting hole 2*k* at the tip of the terminal holder 2 and the locking plate portion 3 is connected to the terminal holder 2 so as to be movable in the lateral direction. In this case, the insertion plate 3*b* is brought close to one side with respect to the connecting hole 2*k* of the terminal placement plate 2*i*. As a result, the insertion groove 3*d* of the locking plate portion 3 communicates with the insertion groove 2*j* of the terminal placement plate 2*i* and the locking piece Te of the connection terminal T is capable of passing through the insertion grooves 2*j* and 3*d* in sequence.

Figure 11:
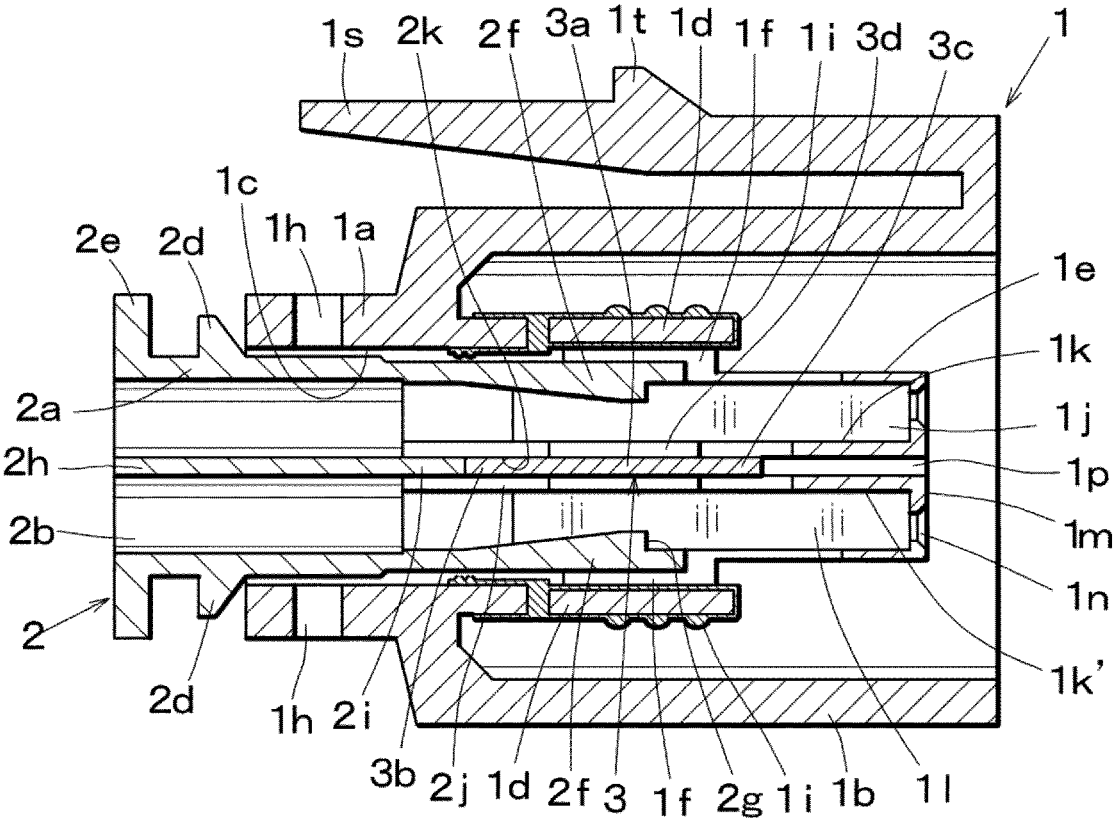
FIG. 11 is a vertical cross-sectional view in which a housing is vertically cut with the terminal holder temporarily inserted.
Figure 12:
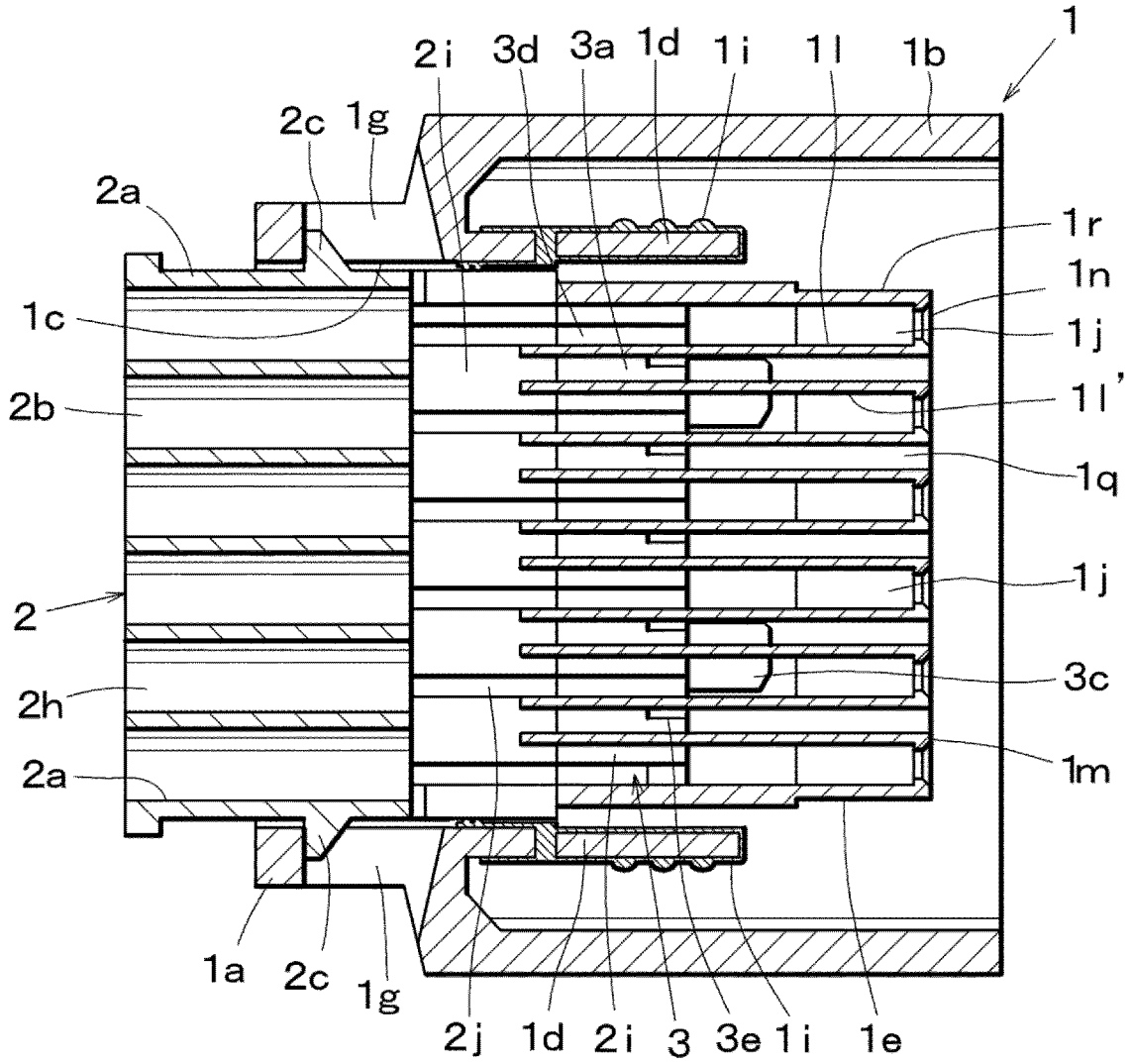
FIG. 12 is a vertical cross-sectional view in which a housing is horizontally cut with the terminal holder temporarily inserted.

The assembly in which the terminal holder 2 and the locking plate portion 3 are integrated in this manner is inserted from the rear of the housing main body 1 into the holder holding portion 1*c* of the middle tube 1*a* along a guide mechanism (not illustrated). As a result of this insertion, the frame portion 2*a* of the terminal holder 2 is assembled, as a temporary insertion state, to the holder holding portion 1*c* as illustrated in FIGS. 11 and 12.

In this temporary insertion state, the front end of the operated end 3*c* of the locking plate portion 3 is positioned near the gap between the bottom plates 1*k* and 1*k*' of the terminal holding portion 1*e*. When the terminal holder 2 and the locking plate portion 3 are temporarily inserted into the housing main body 1, the coupling protrusion 2*c* for temporary insertion of the terminal holder 2 pushes and expands the holder holding portion 1*c* of the housing main body 1 to the right and left, which leads to fitting and coupling to the coupling groove portion 1*g* for temporary insertion, and the front end of the coupling protrusion 2*d* for main insertion abuts against the rear end portion of the holder holding portion 1*c*. In this temporary insertion state, the case lance 2*f* provided on the terminal holder 2 is positioned between the ribs 1*f* between the terminal holding portion 1*e* and the waterproof portion 1*d*.

In this temporary insertion state, the rear end portion of the holder holding portion 1*c* is sandwiched and coupled by the coupling protrusion 2*c* for temporary insertion and the coupling protrusion 2*d* for main insertion. Accordingly, the terminal holder 2 and the locking plate portion 3 do not fall off from the housing main body 1 and the temporary insertion state is maintained. In this manner, the state of assembly of the assemblies does not collapse even in the event of transport of the assembly in which the terminal holder 2 and the locking plate portion 3 are temporarily inserted with respect to the housing main body 1 to the insertion workplace for the connection terminal T for the next process.

Figure 13:
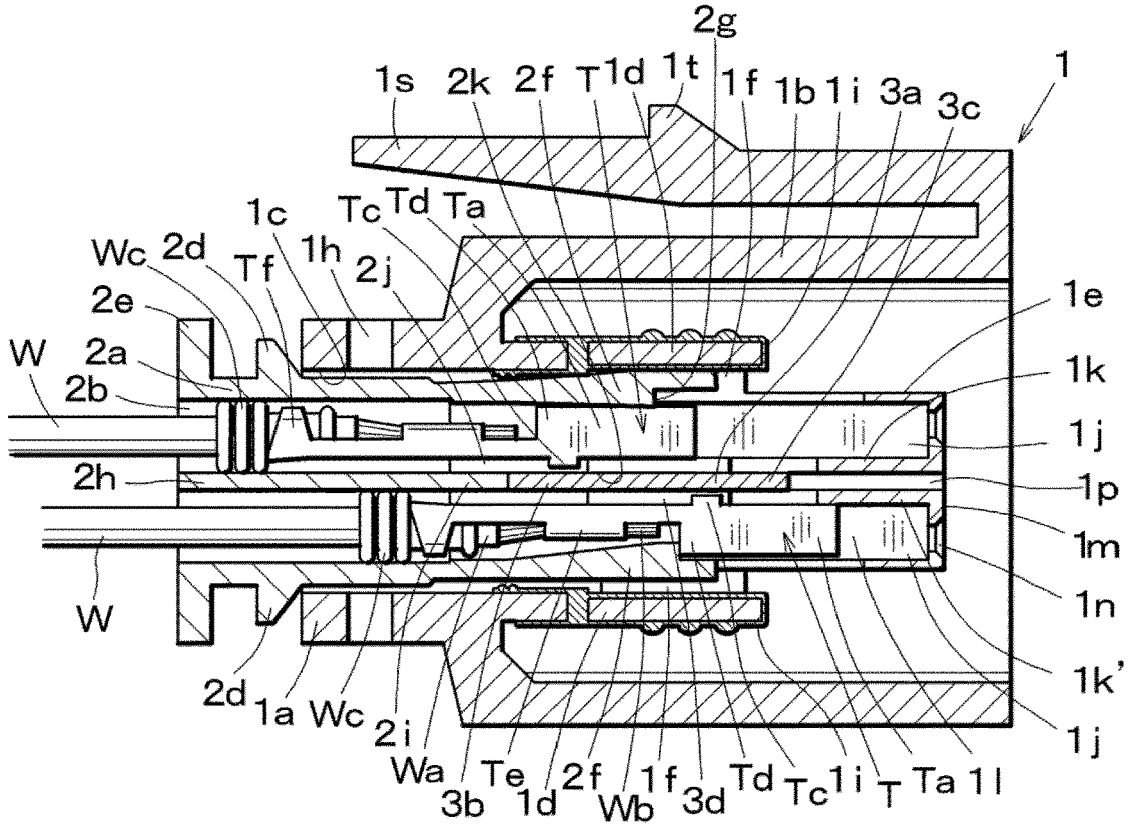
FIG. 13 is a vertical cross-sectional view of the process of primarily inserting the connection terminal in the temporary insertion state of the terminal holder.

Next, as illustrated in FIG. 13, the individual connection terminals T are primarily inserted into the terminal holder 2 from the open hole 2*b* of the terminal holder 2 starting from the connection portion Ta of the connection terminal T. The individual connection portions Ta proceed on the terminal placement plate 2*i* while being guided by the partition walls 1*l* and 1*l*' extending rearward from the terminal holding portion 1*e*. This entails a forward movement of the locking piece Tc of the connection portion Ta in the insertion groove 2*j* of the terminal placement plate 2*i* and, further, the insertion groove 3*d* of the locking plate portion 3.

It should be noted that the connection terminals T during the mounting into the terminal holder 2 are disposed in vertical symmetry in the housing main body 1 and the bottom surfaces 1*d* are inserted back to hack.

In the primary insertion process of the connection terminal T, the connection portions Ta at the tips of the connection terminals T in the upper stage and at the lower limit push up and down the hook portion 2*g* of the case lance 2*f* pass through the hook portion 2*g* of the case lance 2*f* and enter the connection portion accommodating chamber 1*j* as in the case of the connection terminal T in the upper stage. The case lance 2*f* and the waterproof portion 1*d* of the middle tube T a have a slight gap therebetween and the case lance 2*f* is deformable to the outside. When the connection portion Ta passes through the hook portion 2*g*, the case lance 2*f* returns to the original posture and the hook portion 2*g* abuts against the pressed portion Td of the connection portion Ta. Then, each connection terminal T stops at this primary insertion position as in the case of the connection terminal in the lower stage.

Figure 14:
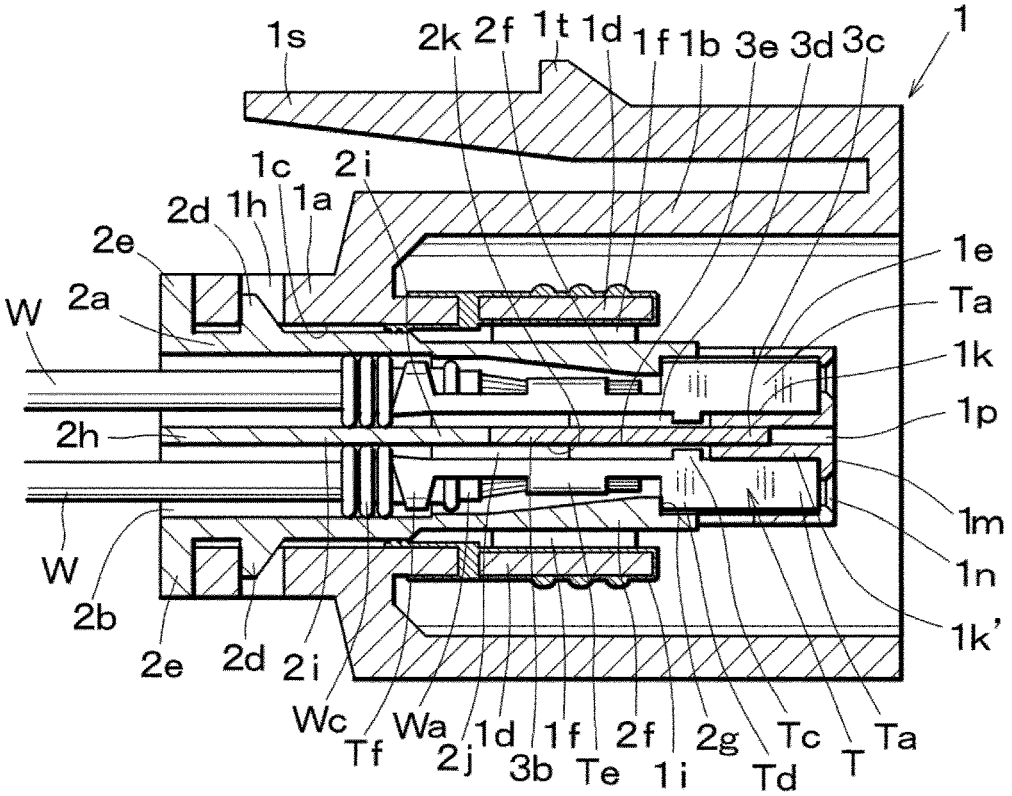
FIG. 14 is a vertical cross-sectional view of a state where the connection terminal is secondarily inserted.

After the completion of the primary insertion of every connection terminal T, the terminal holder 2 is further pushed into the middle tube 1*a* together with the locking plate portion 3. As a result, the hook portion 2*g* of the case lance 2*f* pushes the pressed portion Td of the connection portion Ta forward as illustrated in FIG. 14 and the connection portion Ta of every connection terminal T is pushed in up to a predetermined position in the connection portion accommodating chamber 1*j* by the connection terminal T being moved forward from the primary insertion position to a secondary insertion position.

As a result, the operated end 3*c* of the locking plate portion 3 is inserted into the gap between the bottom plates 1*k* and 1*k*' and, at the same time, the stopper 2*e* of the terminal holder 2 abuts against the rear end portion of the housing main body 1 and the terminal holder 2 and the locking plate portion 3 stop moving forward at this position. In this main insertion process, the coupling protrusion 2*d* for main insertion of the terminal holder 2 pushes and expands the holder holding portion 1*c* of the housing main body 1 up and down, which leads to fitting into the coupling groove portion 1*b* for main insertion, and the terminal holder 2 is coupled to the housing main body 1 in the main insertion state. In this main insertion state, the locking plate portion 3 and the terminal holder 2 incorporating the connection terminal T become immovable in the front-rear direction with respect to the housing main body 1 by the stopper 2*e* and the coupling protrusion 2*d* for main insertion of the terminal holder 2 sandwiching the rear end portion of the holder holding portion 1*c*.

In addition, as for the connection terminal T in this secondary insertion state, the front position is determined with the front end of the connection portion Ta in the connection portion accommodating chamber 1*j* abutting against the inside of the front wall 1*m*. In this stationary state of the connection terminal T, the hook portion 2*g* of the case lance 2*f* abuts against the pressed portion Td of the connection terminal T from the rear and the back slip of the connection terminal T is prevented. At this time, the locking piece Tc of the connection terminal T is stopped at the tip of the insertion groove 3*d* of the locking plate portion 3 via the insertion groove 2*j* of the terminal placement plate 2*i* as a stabilizer.

Figure 15:
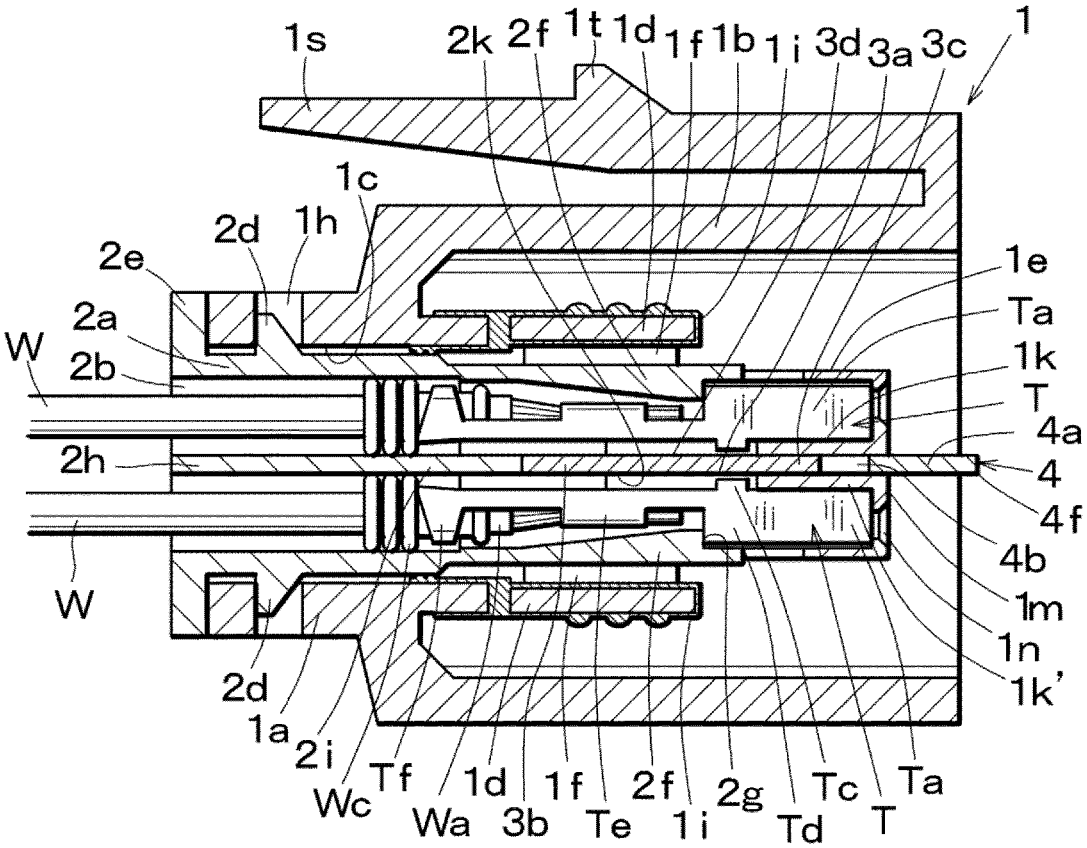
FIG. 15 is a vertical cross-sectional view of a state where the locking plate portion is inserted in the main insertion state of the terminal holder.

As illustrated in FIG. 15, in the main insertion state of the terminal holder 2 and the locking plate portion 3, the separate operating member 4 is pushed in from the push-in port to provided in the front wall 1*m* of the housing main body 1 and the horizontal plate 4*a* and the vertical plate 4*b* are pushed into the gaps of the bottom plates 1*k* and 1*k*' and the partition walls 1*l* and 1*l*'. In addition, the side plates 4*c* on both sides of the operating member 4 are fitted into the recess portions it of the terminal holding portion 1*e*.

Figure 16:
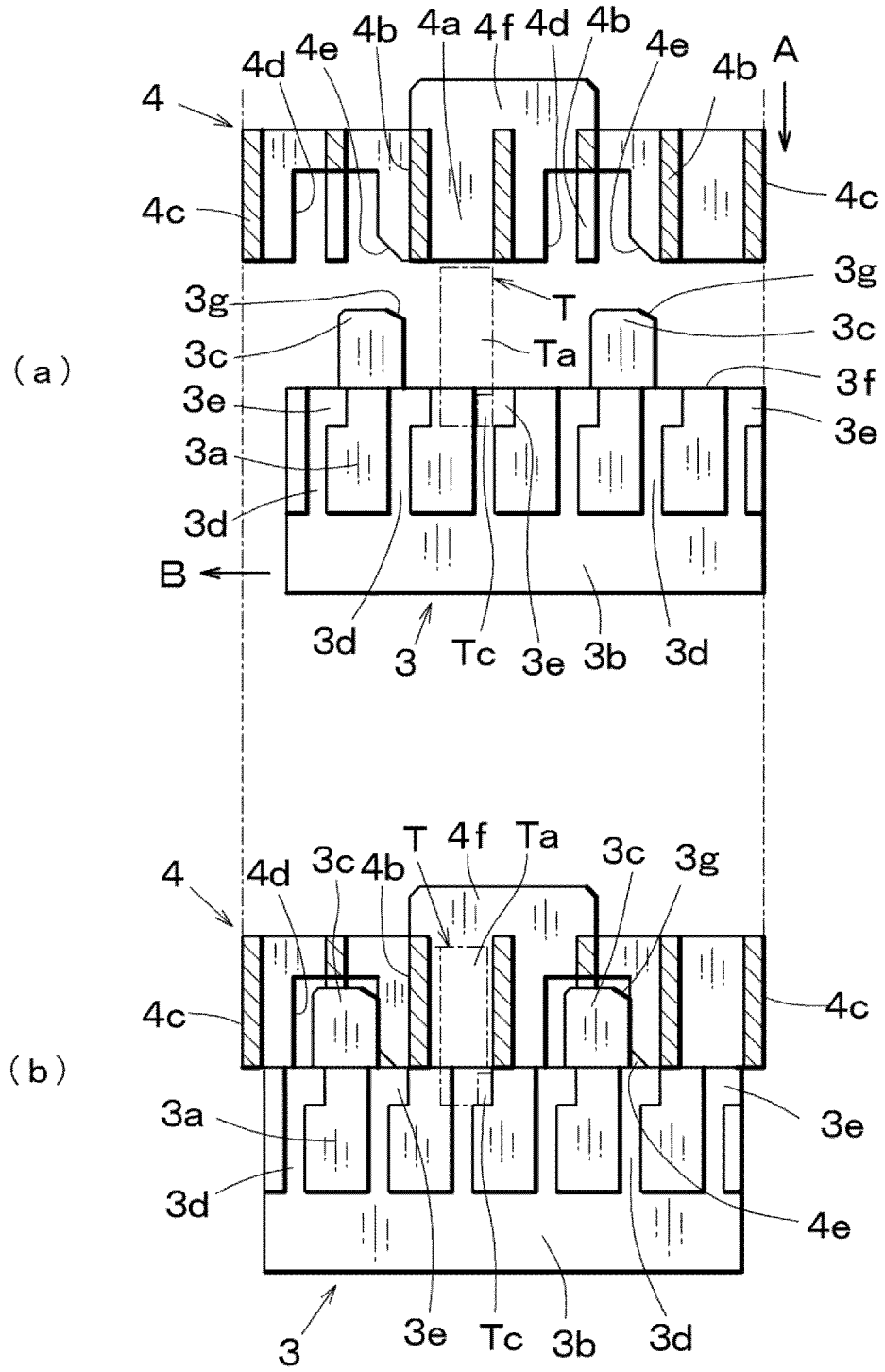
FIG. 16 is an explanatory diagram of the process of pushing in the operating member and laterally moving the locking plate portion.

As a result, the locking plate portion 3 and the operating member 4 face each other in the housing main body 1 as illustrated in FIG. 16(*a*). It should be noted that the connection portion Ta and the locking piece Tc of the connection terminal T are indicated by one-dot chain lines. When the operating member 4 is strongly pushed in with respect to the locking plate portion 3 by means of the push-in piece 4*f* as indicated by the arrow A here, the operated end 3*c* of the locking plate portion 3 enters the recess portion 4*d* of the horizontal plate 4*a* of the operating member 4 as illustrated in FIG. 16(*b*). The pressing force of the operating member 4 causes the push slope portion 4*e* to apply a force proceeding in the lateral direction of the arrow B to the locking plate portion 3 by the inter-slope wedge action and with respect to the receiving slope portion 3*g* of the operated end 3*c*.

With the insertion plate 3*b* of the locking plate portion 3 positioned in the connecting hole 2*k* of the terminal placement plate 2*i*, the operated end 3*c* laterally moves in the gap of the bottom plates 1*k* and 1*k*'. As a result, the locking plate portion 3 moves laterally to the right when viewed from the front with respect to the terminal holder 2 and the housing main body 1. Further, at this position, a leftward movement of the locking plate portion 3 is regulated by the operating member 4, and thus the locking plate portion 3 does not unexpectedly return to the original position.

As a result of the lateral movement of the locking plate portion 3, the locking piece Tc positioned at the front end of the insertion groove 3*d* of the locking plate portion 3 is locked by the locking portion 3*e* provided on the side of the tip of the insertion groove 3*d* without the connection terminal T being moved. As a result, a rearward movement of the locking piece Tc is regulated. The lateral movement distance of the locking plate portion 3 is approximately 0.6 mm, which exceeds the width of the locking piece Tc. In this manner, the locking plate portion 3 does not return to the original position and the locking state of the locking piece Tc of the connection terminal T is maintained by the locking portion 3*e* insofar as the operating member 4 is inserted.

It should be noted that the description in FIG. 16 is a description of the operation on the upper surface of the locking plate portion 3, the same applies to the lower surface, and the rear portion of the locking piece Tc of the connection terminal T disposed on the lower surface side is locked by the locking portion 3*e* on the lower surface side.

When the operating member 4 is sufficiently pushed in, the locking plate portion 3 is reliably moved in the lateral direction and the locking of the locking piece Tc is visually confirmed from the front. When the operating member 4 is colored in a color different from, for example, the color of the housing main body 1 here, the mounting state of the operating member 4 can be visually recognized with greater ease. It should be noted that another method may be used as the mechanism of moving the locking plate portion 3 by means of the operating member 4.

In this manner, the pressed portion 1*d* is locked by the case lance 2*f* and the locking piece Tc is locked by the locking portion 3*e* of the locking plate portion 3 as for the connection terminal T. By these two locking means, back slip attributable to, for example, the electric wire W being pulled out to the rear of the connection terminal T is reliably prevented.

In addition, as illustrated in FIG. 15, the rear end portion of the connection terminal T at the main insertion position is positioned in the open hole 2*b* of the terminal holder 2, the cylindrical sealing material We attached to the connection terminal T is in close contact with the inner wall of the open hole 2*b*, and water infiltration from the rear into the terminal holder 2 and the middle tube 1*a* is prevented. Further, the inside part of the seal portion 1*i* provided on the waterproof portion 1*d* provides sealing between the inside of the middle tube 1*a* and the outside of the terminal holder 2 and inward water infiltration from the gap between the middle tube 1*a* and the terminal holder 2 is prevented.

The electrical connector configured as described above is fitted with the housing of the electrical connector on the other side during use, and the housings are locked by the locking claw 1*t* of the locking arm 1*s*. The insertion end of the connection terminal on the other side is inserted from the opening portion 1*n* of the front wall 1*m* and fitted into the connection portion Ta of the connection terminal T, and then the connection terminals are electrically connected. It should be noted that the push-in piece 4*f* of the operating member 4 at this time remains slightly protruding forward from the terminal holding portion 1*e* of the housing main body 1 and yet the push-in piece 4*f* is inserted into the recess of the housing of the counterpart connector when the connectors are fitted together.

The electrical connector on the other side also has a waterproof structure, the outer tube of the housing on the other side is inserted between the outer tube 1*b* and the middle tube 1*a* of the housing main body 1, the outside part of the seal portion 1*i* provided on the middle tube 1*a* provides sealing between the middle tube 1*a* and the outer tube of the housing H on the other side, and sealing is performed such that no inward water infiltration occurs from between the middle tube 1*a* and the outer tube of the housing H on the other side. In this manner, the sealing structure by means of the seal portion 1*i* and the cylindrical sealing material Wc prevents water infiltration into the holder holding portion 1*c* and fitting with the waterproof housing H on the other side leads to functioning as a waterproof connector.

In the example, the connection terminals T are inserted into the upper and lower stages of the electrical connector with the bottom surfaces Tb facing each other, and thus the insertion grooves 3*d* of the locking pieces Tc respectively formed in the locking plate portion 3 and the terminal placement plate 2*i* of the terminal holder 2 are formed in both the upper and lower surfaces. However, the insertion groove may be formed in only one surface in the case of an electrical connector in which the connection terminal T is incorporated in one stage.

In addition, the back slip regulation with respect to the locking piece Tc is released when the operating member 4 is pulled out by the push-in piece 4*f* and then the locking plate portion 3 is laterally moved to the left by a jig so that the connection terminal T is taken out of the housing main body 1 for repairing or the like. After the release, the case lance 2*f* may be unlocked with respect to the connection terminal T by dedicated jig insertion from the opening portion in of the front wall 1*m* and the connection terminal T may be pulled out rearward.

In the example described above, the locking plate portion 3 is provided with the locking portion 3*e* locking the locking piece Tc of the connection terminal T. However, when the lengths of the bottom plates 1*k* and 1*k'* in the front-rear direction are increased, every connection portion Ta is caused to reach parts on the bottom plates 1*k* and 1*k'* during the secondary insertion of the connection terminal T, and the bottom plates 1*k* and 1*k'* are also provided with the insertion groove of the locking piece Tc, the locking piece Tc can be pushed into the insertion grooves in the bottom plates 1*k* and 1*k'* during the secondary insertion of the connection terminal T. Then, the locking of the locking piece Tc can also be performed not by the locking portion 3*e* but by the front edge 3*f* of the laterally moved locking plate portion 3 blocking the insertion grooves in the bottom plates 1*k* and 1*k'*.

In addition, although the insertion groove 2*j* is also provided in the terminal placement plate 2*i* of the terminal holder 2, the insertion groove 2*j* of the terminal holder 2 can be omitted insofar as the locking piece Tc of the connection terminal T can be directly guided to the insertion groove 3*d* of the locking plate portion 3 during the insertion of the connection terminal T.

Although the connection terminal T is a receiving-type connection terminal in the example, the invention is also applicable to an electrical connector in which the connection terminal is an insertion-type connection terminal. Further, the number of the connection terminals T can be changed and the number of the stages can be one or three or more.

It should be noted that the terms of up, down, right, left, front, and rear in the example are described with respect to the drawings and may differ from those in an actual electrical connector.

REFERENCE SIGNS LIST

1 Housing main body
1*a* Middle tube
1*b* Outer tube
1*c* Holder holding portion
1*e* Terminal holding portion
1*j* Connection portion accommodating chamber
1*k*, 1*k'* Bottom plate
1*l*, 1*l'* Partition wall
1*m* Front wall
1*n* Opening portion
1*o* Push-in port
2 Terminal holder
2*a* Frame portion
2*b* Open hole
2*f* Case lance
2*i* Terminal placement plate
2*j*, 3*d* Insertion groove
3 Locking plate portion
3*a* Substrate portion
3*b* Insertion plate
3*c* Operated end
3*e* Locking portion
3*g* Receiving slope portion
4 Operating member
4*a* Horizontal plate
4*b* Vertical plate
4*e* Push slope portion
T Connection terminal
Ta Connection portion
Tc Locking piece
W Electric wire

The invention claimed is:

1. An electrical connector comprising:

a housing main body;

a terminal holder inserted into the housing main body from a rear of the housing main body and incorporating a plurality of connection terminals having locking pieces;

a locking plate portion connected to a front end of the terminal holder and movable in a lateral direction orthogonal to the direction in which the terminal holder is inserted; and an operating member moving the locking plate portion inserted in the housing main body together with the terminal holder in the lateral direction, wherein the housing main body is provided with a holder holding portion holding the terminal holder in a rear portion and a terminal holding portion individually holding a connection portion of the connection terminal in a front portion, a plurality of open holes into which the connection terminals are respectively inserted are provided in a rear portion of the terminal holder, an insertion groove allowing the locking piece of the connection terminal to pass through a substrate portion is formed in the locking plate portion, an insertion plate connected to the terminal holder so as to be movable in the lateral direction is provided in a rear portion of the substrate portion, and an operated end for a movement in the lateral direction by the operating member is provided at a part of the substrate portion, the operating member is provided with an operating portion pushed in from a push-in port provided in the terminal holding portion of the housing main body and acting on the operated end of the locking plate portion, and as a result of the push, the operating portion of the operating member moves the locking plate portion in the lateral direction, locking is performed by the locking plate portion with respect to the locking piece of the connection terminal, and a back slip of the connection terminal is regulated.

2. The electrical connector according to claim 1, wherein a stepped locking portion is provided in a front end side portion of the insertion groove of the locking plate portion and the locking portion regulates the back slip of the connection terminal by the locking plate portion moving in the lateral direction.

3. The electrical connector according to claim 1, wherein an insertion groove communicating with the insertion groove of the locking plate portion is formed in a bottom plate of the terminal holding portion of the housing main body and the insertion groove of the bottom plate is blocked and the locking piece of the connection terminal is locked by the locking plate portion moving in the lateral direction.

4. The electrical connector according to claim 1, wherein the connection terminals are incorporated in one upper stage and one lower stage with respect to the terminal holder and the insertion grooves of the locking plate portion are formed in both upper and lower surfaces of the locking plate portion.

5. The electrical connector according to claim 1, wherein the terminal holder is provided with an insertion groove so as to communicate with the insertion groove of the locking plate portion.

6. The electrical connector according to claim 1, wherein the locking plate portion is moved in the lateral direction by a wedge action with the operated end of the locking plate portion by the operating portion of the operating member abutting against the locking plate portion and being pushed in.

7. The electrical connector according to claim 1, wherein the operating member in an insertion state thereof functions as confirmation means for confirming the movement of the locking plate portion in the lateral direction.

8. The electrical connector according to claim 1, wherein the push-in port of the operating member is provided in a front surface of the terminal holding portion of the housing main body.

9. The electrical connector according to claim 1, wherein the terminal holder allows an elastic case lance to protrude forward and the case lance locks a part of the connection terminal.

10. The electrical connector according to claim 1, wherein the terminal holding portion of the housing main body has a waterproof structure preventing water infiltration.

11. A method for locking a connection terminal in an electrical connector including a housing main body, a terminal holder inserted into the housing main body from a rear of the housing main body and incorporating a plurality of connection terminals having locking pieces, a locking plate portion connected to a front end of the terminal holder and movable in a lateral direction orthogonal to the direction in which the terminal holder is inserted, and an operating member moving the locking plate portion inserted in the housing main body together with the terminal holder in the lateral direction, wherein, in the method for locking the electrical connector, a rear portion of the locking plate portion is connected to the terminal holder so as to be movable in the lateral direction, the connection terminal is inserted by the locking piece of the connection terminal moving forward in an insertion groove formed in the locking plate portion when the connection terminal is inserted, the locking plate portion is moved in the lateral direction by the operating member being pushed into the housing main body from a push-in port provided in the housing main body after the insertion of the connection terminal, and a rear portion of the locking piece of the connection terminal is locked and a rearward movement of the connection terminal is regulated as a result.

* * * * *